US011779978B2

(12) United States Patent
Nagai et al.

(10) Patent No.: US 11,779,978 B2
(45) Date of Patent: Oct. 10, 2023

(54) CHATTERING DETECTION METHOD FOR COLD ROLLING MILL, CHATTERING DETECTION DEVICE FOR COLD ROLLING MILL, COLD ROLLING METHOD, AND COLD ROLLING MILL

(71) Applicant: JFE STEEL CORPORATION, Tokyo (JP)

(72) Inventors: Yu Nagai, Tokyo (JP); Koichi Nohara, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 267 days.

(21) Appl. No.: 17/417,298

(22) PCT Filed: Sep. 5, 2019

(86) PCT No.: PCT/JP2019/034977
§ 371 (c)(1),
(2) Date: Jun. 22, 2021

(87) PCT Pub. No.: WO2020/137014
PCT Pub. Date: Jul. 2, 2020

(65) Prior Publication Data

US 2022/0072594 A1 Mar. 10, 2022

(30) Foreign Application Priority Data

Dec. 27, 2018 (JP) ..... 2018-243856

(51) Int. Cl.
*B21B 38/00* (2006.01)
*B21B 1/28* (2006.01)
(Continued)

(52) U.S. Cl.
CPC ..... *B21B 38/008* (2013.01); *B21B 1/28* (2013.01); *B21B 37/007* (2013.01); *B21C 51/00* (2013.01); *B21B 2001/221* (2013.01)

(58) Field of Classification Search
CPC ..... B21B 37/007; B21B 38/008; B21B 1/28
See application file for complete search history.

(56) References Cited

U.S. PATENT DOCUMENTS 5,515,731 A 5/1996 Weisshaar et al.
6,463,775 B1 * 10/2002 Kodama ..... B21B 38/008 72/11.1
(Continued)

FOREIGN PATENT DOCUMENTS

CA 2 954 502 A1 1/2016
CN 1319035 A 10/2001
(Continued)

OTHER PUBLICATIONS

Kim, Translation of KR-20100108033 (Year: 2010).*
(Continued)

*Primary Examiner* — Bobby Yeonjin Kim
(74) *Attorney, Agent, or Firm* — Oliff PLC

(57) ABSTRACT

A chattering detection method for a cold rolling mill, the method including: measuring a vibration of a cold rolling mill; calculating a time waveform of vibration intensity by performing frequency analysis on a time waveform of the measured vibration of the cold rolling mill for a predetermined period equal to or shorter than a time in which a periodic vibration continues without converging; and detecting a chattering sign vibration of the cold rolling mill based on a number of points having vibration intensity values that exceed a predetermined threshold, the points being included in the calculated time waveform of the vibration intensity.

16 Claims, 5 Drawing Sheets

(51) Int. Cl.

| | |
|---|---|
| ***B21B 37/00*** | (2006.01) |
| ***B21C 51/00*** | (2006.01) |
| *B21B 1/22* | (2006.01) |

(56) References Cited

U.S. PATENT DOCUMENTS

| | | | |
|---|---|---|---|
| 6,621,860 | B1 | 9/2003 | Yamaguchi et al. |
| 6,687,629 | B1 | 2/2004 | Yamaguchi et al. |
| 6,795,496 | B1 | 9/2004 | Soma et al. |
| 7,188,496 | B2 | 3/2007 | Karam et al. |
| 9,138,848 | B2 | 9/2015 | Ueno |
| 9,211,624 | B2 | 12/2015 | Tanaka |
| 9,285,797 | B2 | 3/2016 | Kondo |
| 9,463,545 | B2 | 10/2016 | Okita et al. |
| 9,791,847 | B2 | 10/2017 | Ono |
| 2006/0236736 | A1 | 10/2006 | Abi Karam et al. |
| 2012/0101624 | A1 | 4/2012 | Ueno |
| 2012/0232812 | A1 | 9/2012 | Okita et al. |
| 2012/0318062 | A1 | 12/2012 | Tanaka |
| 2013/0164092 | A1 | 6/2013 | Kondo |
| 2015/0338842 | A1 | 11/2015 | Ono |
| 2022/0072594 | A1 | 3/2022 | Nagai et al. |

FOREIGN PATENT DOCUMENTS

| | | | | |
|---|---|---|---|---|
| CN | 1772405 | A | | 5/2006 |
| CN | 101464429 | A | | 6/2009 |
| CN | 102179413 | A | | 9/2011 |
| CN | 102554692 | A | | 7/2012 |
| CN | 102672539 | A | | 9/2012 |
| CN | 102825506 | A | | 12/2012 |
| CN | 102836885 | A | | 12/2012 |
| CN | 202606512 | U | | 12/2012 |
| CN | 103079757 | A | | 5/2013 |
| CN | 103521531 | A | | 1/2014 |
| CN | 104070066 | A | | 10/2014 |
| CN | 105204443 | A | | 12/2015 |
| CN | 105522000 | A | | 4/2016 |
| CN | 107983781 | A | | 5/2018 |
| CN | 106845429 | B | | 5/2020 |
| DE | 60 2005 003 633 | T2 | | 10/2008 |
| EP | 0 638 375 | A1 | | 2/1995 |
| EP | 1 657 003 | A1 | | 5/2006 |
| FR | 2 723 011 | B1 | | 9/1996 |
| JP | S50-159453 | A | | 12/1975 |
| JP | H05-200648 | A | | 8/1993 |
| JP | H08-108205 | A | | 4/1996 |
| JP | H08-141612 | A | | 6/1996 |
| JP | 2000-158044 | A | | 6/2000 |
| JP | 2000-233368 | A | | 8/2000 |
| JP | 2001-137915 | A | | 5/2001 |
| JP | 2013-010110 | A | | 1/2013 |
| JP | 2013-099757 | A | | 5/2013 |
| JP | 2013-111614 | A | | 6/2013 |
| JP | 2014-004612 | A | | 1/2014 |
| JP | 2015-009261 | A | | 1/2015 |
| JP | 2016-153138 | A | | 8/2016 |
| JP | 2017-119285 | A | | 7/2017 |
| JP | 2018-118312 | A | | 8/2018 |
| KR | 20100108033 | A | * | 10/2010 ..... B21B 38/008 |
| TW | 458821 | B | | 10/2001 |
| TW | 462900 | B | | 11/2001 |
| TW | 559668 | B | | 11/2003 |
| TW | 201729917 | A | | 9/2017 |
| TW | I712780 | B | | 12/2020 |
| WO | 00/72989 | A1 | | 12/2000 |

OTHER PUBLICATIONS

Jan. 7, 2022 Extended European Search Report issued in European Patent Application No. 19903663.3.

Apr. 14, 2020 Office Action issued in Taiwanese Patent Application No. 108135846.

Nov. 26, 2019 International Search Report issued in International Patent Application No. PCT/JP2019/034977.

Nov. 26, 2019 Written Opinion of the International Searching Authority issued in International Patent Application No. PCT/JP2019/034977.

Chen et al., "Measurement and control ofchatter marks for 1220HC six-high tandem cold rolling mill," Journal of Chongqing University, pp. 1-6, (2011), vol. 34, No. 11.

Sep. 30, 2022 Office Action issued in Chinese Patent Application No. 201980085857.9.

Sep. 22, 2022 Office Action issued in Taiwanese Patent Application No. 11141397490.

"Western Electric rules," https://en.wikipedia.org/w/index.php?title=WesternElectricrules&oldid=874487816 "Western Electric rules" Wikipedia, (2018), 6 pages.

Usmani et al., "Chatter Detection Using Principal Component Analysis In Cold Rolling Mill", Diagnostyka, pp. 73-81, (2018), vol. 19, No. 1.

* cited by examiner

CHATTERING DETECTION METHOD FOR COLD ROLLING MILL, CHATTERING DETECTION DEVICE FOR COLD ROLLING MILL, COLD ROLLING METHOD, AND COLD ROLLING MILL

FIELD

The present invention relates to a chattering detection method for a cold rolling mill, a chattering detection device for a cold rolling mill, a cold rolling method, and a cold rolling mill.

BACKGROUND

With the increasing demand for stronger and thinner thin steel sheet products, the level of technology required for rolling equipment is increasing in recent years. In particular, phenomenon called chattering, in which a cold rolling mill abnormally vibrates, is more likely to occur in harder and thinner materials to be rolled, and has a major challenge in the quality and the production efficiency in a cold rolling process of high-quality products.

Although there are various factors that cause chattering, occurrence of chattering called third octave chattering is frequently reported in general cold rolling mills, particularly, in tandem cold rolling mills. This chattering mostly occurs at frequencies of around 100 to 200 Hz, and involves opposite phase vibration of work rolls in the vertical direction. Chattering generally occurs in high-speed rolling. The vibration rapidly grows and causes a roar in many cases.

Once chattering occurs, it causes large variations in the thickness of a sheet, and a portion of a material to be rolled in which the chattering has occurred is not approved as a product, resulting in decrease of the yield rate of production. Chattering with vibration of large intensity may cause breakage of a sheet that is being rolled at high-speed. For these issues, when there is a concern about occurrence of chattering, the operator operating the machine reduces the speed of rolling, avoiding a speed range that causes chattering. In other words, chattering limits the processing capacity of a cold rolling mill.

According to the theory of dynamic continuous rolling, while a general tension limit control is performed (a control to set the value of tension within a range of limit values only when the amount of change in tension exceeds a certain range), the act of self-stabilization is exerted to enhance an automatic reduction in a change in the thickness of the sheet by changing backward tension of a rolling stand where a disturbance has been caused in a direction to reduce the change in the thickness of the sheet. However, a lot of studies report that, under a certain condition of rolling, characteristic vibration of a rolling roll system occurs in the vertical direction in a self-excited fashion and eventually diverges. According to the studies, this vibration is a cause of chattering. In other words, chattering phenomenon is a phenomenon in which self-excitation vibration occurs and converges as a result of self-stabilization and again occurs while self-stabilization acts to reduce a change in the thickness of a sheet, and as the occurrence and the convergence are repeated, the vibration state completely transitions to an unstable state, and the vibration diverges.

As described in Patent Literature 1 and Patent Literature 2, a method to reduce chattering is known that detects the coefficient of friction between the work rolls and a material to be rolled and adjusts the friction coefficient in an appropriate range that causes no chattering. As a method to adjust the friction coefficient, these literatures describe a method of changing the conditions of supply of lubricating oil (rolling oil). Furthermore, Patent Literature 3 describes a method for detecting chattering by performing frequency analysis on a vibration measured by a vibrometer installed in a mill housing. These methods are effective for detecting chattering having occurred and preventing defective parts from being sent to subsequent processes or for minimizing defective parts by immediately changing the operational conditions to prevent occurrence of chattering.

CITATION LIST

Patent Literature

Patent Literature 1: Japanese Patent Application Laid-open No. 2013-99757

Patent Literature 2: Japanese Patent Application Laid-open No. 2001-137915

Patent Literature 3: Japanese Patent Application Laid-open No. 2015-9261

SUMMARY

Technical Problem

With the methods described in Patent Literature 1 and Patent Literature 2, however, it is sometimes difficult to precisely determine a dangerous zone in which chattering occurs even by using indexes such as the friction coefficient and the forward slip ratio. Furthermore, the method of changing the manners of supplying rolling oil is not capable of handling sudden changes in the conditions of a mother sheet and conditions of lubrication. The method described in Patent Literature 3 is not effective in capturing a sign of chattering that rapidly grows as described above, or in preventing occurrence of a serious trouble such as breakage.

To overcome the above issues, the present invention aims to provide a chattering detection method for a cold rolling mill, a chattering detection device for a cold rolling mill, a cold rolling method, and a cold rolling mill that are able to detect a chattering sign vibration and prevent occurrence of troubles derived from chattering.

Solution to Problem

To solve the problem and achieve the object, a chattering detection method for a cold rolling mill according to the present invention includes: a measuring step of measuring a vibration of a cold rolling mill; a calculating step of calculating a time waveform of vibration intensity by performing frequency analysis on a time waveform of the vibration measured at the measuring step for a predetermined period equal to or shorter than a time in which a periodic vibration continues without converging; and a sign vibration determining step of detecting a chattering sign vibration of the cold rolling mill based on a number of points having vibration intensity values that exceed a predetermined threshold, the points being included in the time waveform of the vibration intensity calculated at the calculating step.

Moreover, in the chattering detection method for the cold rolling mill according to the present invention, a period for which the frequency analysis is performed is equal to or shorter than 0.5 second.

Moreover, the chattering detection method for the cold rolling mill according to the present invention further includes a step of reducing a speed of rolling of the cold rolling mill when a chattering sign vibration of the cold rolling mill is detected at the sign vibration determining step.

Moreover, a chattering detection device for a cold rolling mill according to the present invention includes: a vibration measuring unit configured to measure a vibration of a cold rolling mill; and a sign vibration determining unit configured to: calculate a time waveform of vibration intensity by performing frequency analysis on a time waveform of vibration measured by the vibration measuring unit for a predetermined period equal to or shorter than a time in which a periodic vibration continues without converging; and detect a chattering sign vibration of the cold rolling mill based on the number of points having vibration intensity values that exceed a predetermined threshold, the points being included in the time waveform of the calculated vibration intensity.

Moreover, in the chattering detection device for the cold rolling mill according to the present invention, the sign vibration determining unit is configured to conduct frequency analysis for a period of equal to or shorter than 0.5 second.

Moreover, in the chattering detection device for the cold rolling mill according to the present invention, the sign vibration determining unit is configured to reduce a speed of rolling of the cold rolling mill when a chattering sign vibration of the cold rolling mill is detected.

Moreover, a cold rolling method according to the present invention includes a step of cold rolling using the chattering detection method for the cold rolling mill according to the present invention.

Moreover, a cold rolling mill according to the present invention includes the chattering detection device for the cold rolling mill according to the present invention.

Advantageous Effects of Invention

With the chattering detection method for a cold rolling mill, the chattering detection device for a cold rolling mill, the cold rolling method, and the cold rolling mill according to the present invention, a chattering sign vibration can be detected to prevent occurrence of troubles derived from chattering.

DESCRIPTION OF EMBODIMENTS

Deep study about chattering of a cold rolling mill by the inventors of the present invention reveals that a small vibration occurs before occurrence of a vibration the intensity of which is large enough to be accompanied by a roar. According to the study, intensity of the small vibration gradually increases while the vibration repeatedly occurs and converges, and the vibration eventually diverges and causes chattering. Based on this, the inventors of the present invention conceived of a technical thought that troubles derived from chattering could be prevented by detecting such a small vibration as a sign of chattering.

In the present invention, vibrations of a housing of a cold rolling mill are measured using an accelerometer. Vibrations may be measured at any place that allows easy installation of the accelerometer, if the place is on a side surface of the housing of the cold rolling mill. It is, however, preferable to measure vibrations of a place that undergoes vibrations having the largest intensity, depending on the structure of the rolling mill and the conditions of chattering. Generally, once chattering occurs, vibrations in the vertical direction mainly act, and work rolls small in mass most heavily vibrate. The accelerometer is therefore installed at the level of work rolls in a housing post to improve accuracy of detection of small vibrations.

Some reports, however, indicate that chattering occurs with vibrations of vertical vibration and horizontal (the direction of rolling) vibration coupled together. It is therefore preferable to measure vibrations depending on the individual situations. With regards to the direction of measurement, the accelerometer may generally measure vertical vibration, which is, however, not limiting if the intensity detected is large. Furthermore, such chattering that causes variations in the thickness of sheet frequently changes the load of rolling and the tension on the steel sheet at areas in front of and behind a rolling stand. A desired effect of capturing a chattering sign vibration thus may be obtained not only by directly measuring vibration using the accelerometer but by measuring variations in the load of rolling and in the tension between the rolling stands.

Figure 1:
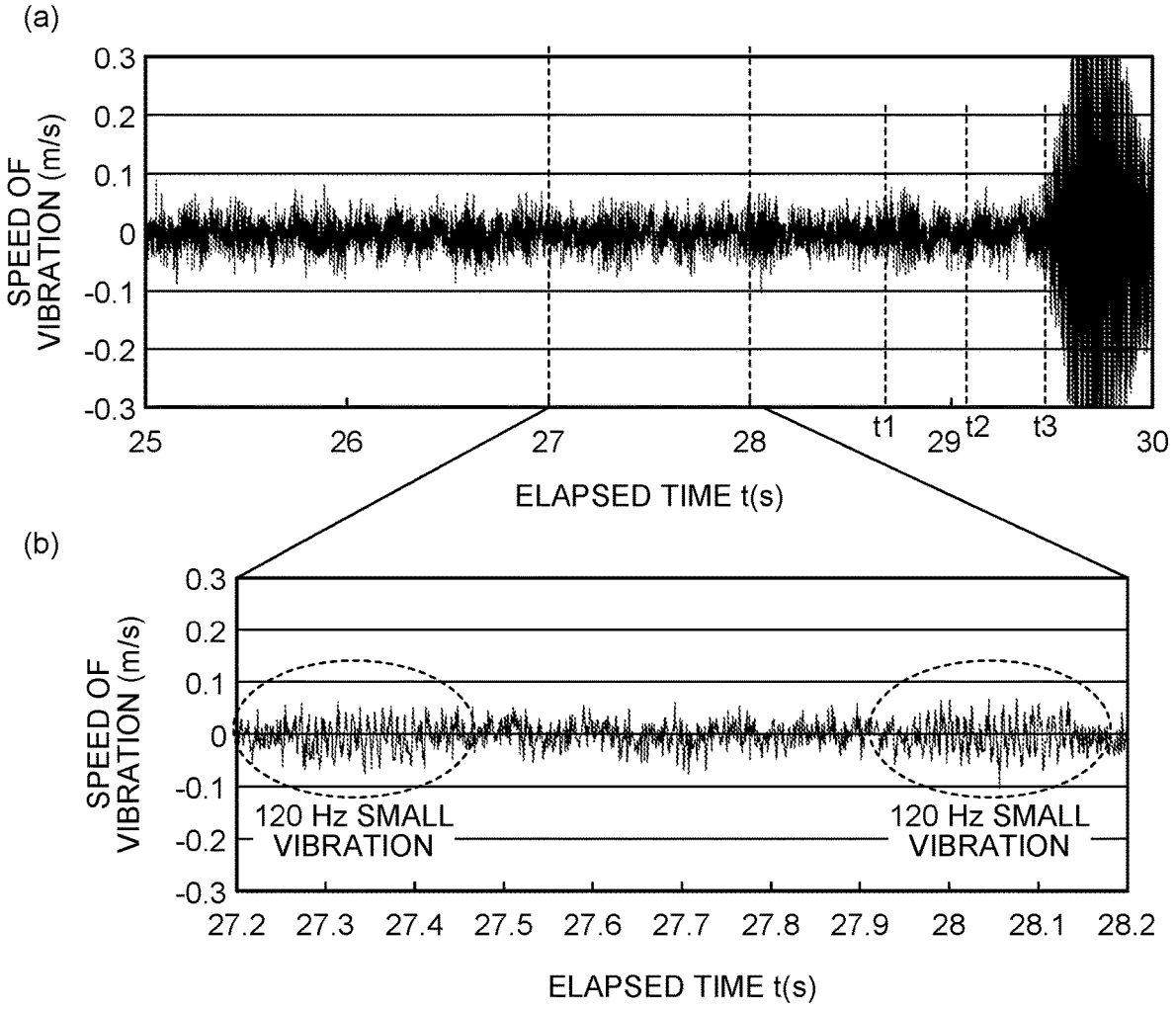
FIG. 1 is a graph that indicates an example time waveform of the speed of vibration measured by an accelerometer.

FIG. 1 is a graph that indicate an example time waveform of the speed of vibration measured by the accelerometer. In the example of FIG. 1, the speed of vibration is measured with a sampling frequency set at 1500 Hz. As illustrated in FIG. 1(*a*), in this example, chattering with a roar occurs at a frequency of around 120 Hz during high-speed rolling (after the elapsed time t=t3). As illustrated in FIG. 1(*b*), however, at the stage of several seconds prior to recognition of occurrence of chattering (that is, occurrence of a roar), a small vibration at a frequency of around 120 Hz first occurs. The small vibration is not continuous, however, it gradually increases its intensity while repeatedly occurring and converging, and eventually becomes chattering of large intensity.

Figure 2:
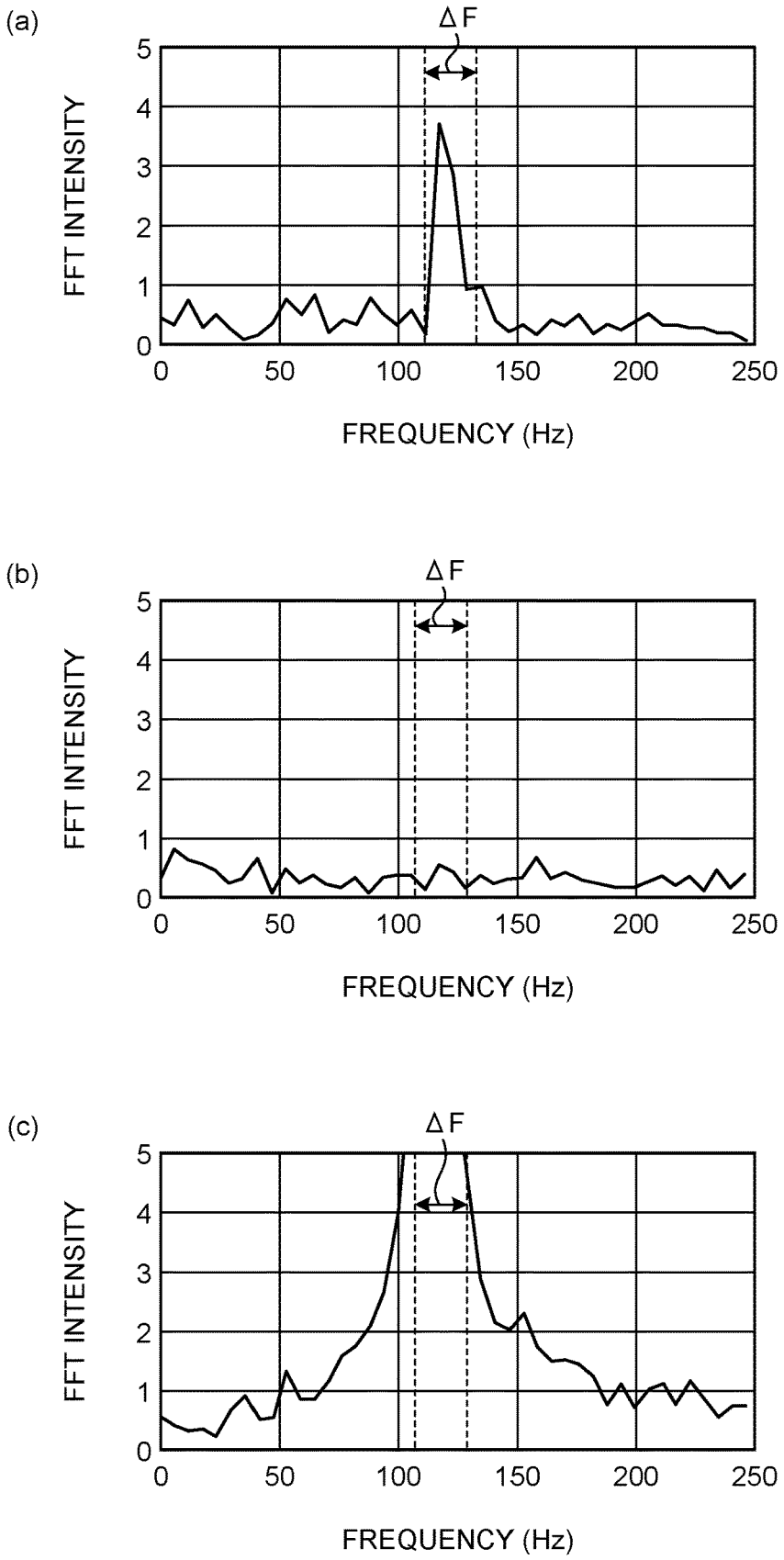
FIG. 2 is a graph that indicates results obtained by performing FFT analysis on the time waveform of the speed of vibration illustrated in FIG. 1.

FIGS. 2(*a*) to 2(*c*) indicate results of FFT (fast Fourier transform) analysis, as one of methods of frequency analysis, performed on the time waveform of the speed of vibration illustrated in FIG. 1, specifically, on every 256 data points (=every 0.17 second). FIGS. 2(*a*) to 2(*c*) indicate the results of FFT analysis performed at the elapsed time t=t1 (=28.7 seconds), t2 (=29.1 seconds), and t3 (=29.5 seconds), respectively. In each graph, the horizontal axis indicates the frequency, and the vertical axis indicates the FFT intensity. As indicated in FIGS. 2(*a*) to (*c*), in this example, the FFT intensity is increased at around a 120 Hz frequency (FIG. 2(*a*)). Immediately after the increase, the vibration is decreased (FIG. 2(*b*)), and soon after that, the vibration becomes large and diverges (FIG. 2(*c*)). Such vibration behavior is seen right before occurrence of chattering. Note that in FIGS. 2(*a*) to (*c*), ΔF indicates a range in which the vibration behavior is determined.

Figure 3:
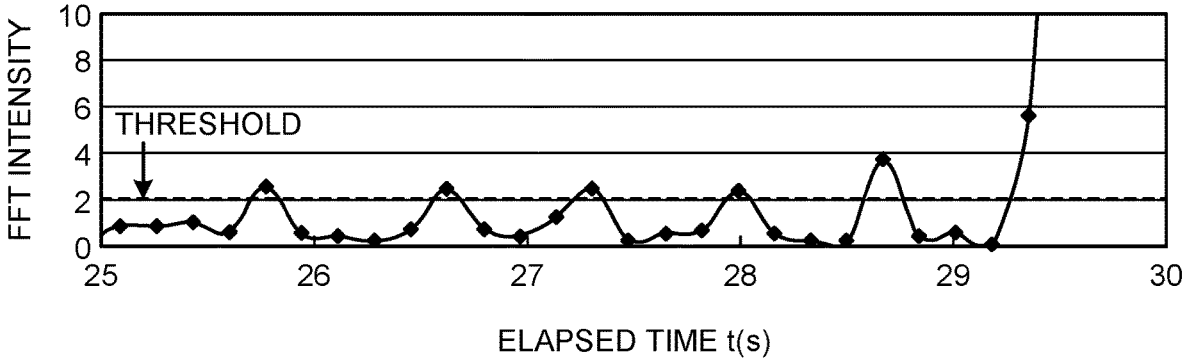
FIG. 3 is a graph in which values of FFT intensity indicated in FIG. 2 are plotted with the horizontal axis as a time axis.

Furthermore, out of the results of FFT analysis obtained at the respective times of FIG. 2(*a*) to (*c*), the largest values of FFT intensity in the range of 110 to 120 Hz frequency, in which chattering occurs, are plotted on the graph of FIG. 3 with the horizontal axis as a time axis. A threshold to determine the presence or absence of vibration is added to FIG. 3. The threshold allows for determination of occurrence and convergence of a chattering sign vibration as indicated on the time waveforms of FIGS. 1(*a*) and (*b*).

Figure 4:
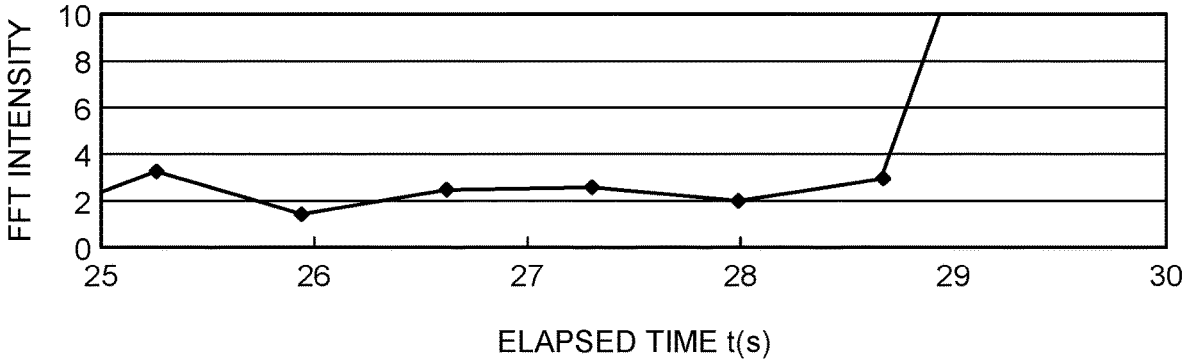
FIG. 4 is a graph in which values of FFT intensity obtained by performing FFT analysis for a different period are plotted with the horizontal axis as a time axis.

On the other hand, FIG. 4 is a graph in which the largest values of FFT intensity in the range of 110 to 120 Hz are plotted, as with the example of FIG. 3, based on the results of FFT analysis performed on every 1024 data points (=every 0.68 second). In the example of FIG. 4, the presence or absence of a chattering sign vibration cannot be determined. Because the chattering sign vibration repeatedly occurs and converges, with the FFT analysis the period of which is 0.68 second, which is longer than the period of repetition, the intensity is averaged, and thus noticeable variations are not shown in FFT intensity.

The above results reveal that occurrence of a chattering sign vibration can be captured by performing frequency analysis, such as FFT analysis, on a period equal to or shorter than the time period in which the chattering sign vibration continues without converging. In most cases, the time in which the chattering sign vibration continues without converging is shorter than 0.5 second. It is therefore preferable to set the period for frequency analysis at 0.5 second or shorter. An increase in the period for frequency analysis needs more sampling points of vibration values, and also needs high-speed analysis. Larger processing capacity is therefore necessary. The upper limit of a period for frequency analysis is therefore set, considering an appropriate range of the load of the processor.

Based on such results of frequency analysis illustrated in FIG. 3, the presence or absence of a chattering sign vibration can be determined by checking the number of points, out of a predefined number of points, exceed the threshold. In the example of FIG. 3, for example, if two points out of the past ten points exceed the threshold, any abnormality is determined to have occurred, and such determination processing is made to avoid overdetection of an abnormal condition when noise is picked. For example, as the method described in Patent Literature 3, simply determining the presence or absence of a point exceeding a threshold frequently leads to such overdetection. If a sign of chattering that may cause a serious trouble such as breakage during high-speed rolling are overdetected, a speed reduction may be unnecessarily performed with the intention to avoid troubles, and such determination processing is therefore necessary.

Performing the above-described determination processing enables determination on a sign that predicts occurrence of chattering with large vibration intensity while avoiding overdetection. The criterion of determination on the number of points, out of predefined number of points, exceeding a threshold, may be set based on data measured using an actual machine, depending on the time of duration of a sign vibration and the period for the frequency analysis. If any abnormality is detected by the above-described method, the operating conditions need to be changed by any method, otherwise large chattering derived from vibration divergence may occur. To avoid this, a detector outputs a signal to a programmable logic controller (PLC) that controls the rolling mill, to automatically reduce the speed of rolling. This operation is more beneficial in preventing occurrence of chattering with large intensity.

The configuration and operation of a chattering detection device, in an embodiment of the present invention, conceived of based on the above thoughts will now be described.

Figure 5:
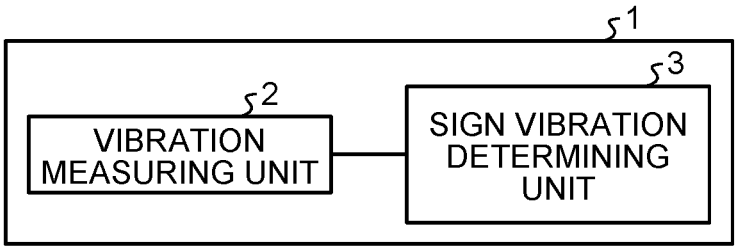
FIG. 5 is a block diagram that illustrates the configuration of a chattering detection device of an embodiment of the present invention.

FIG. 5 is a block diagram that illustrates the configuration of the chattering detection device in an embodiment of the present invention. As illustrated in FIG. 5, a chattering detection device 1 of a cold rolling mill in the embodiment of the present invention is a machine to detect chattering of the cold rolling mill. The chattering detection device 1 includes a vibration measuring unit 2 and a sign vibration determining unit 3.

The vibration measuring unit 2 includes an accelerometer. The vibration measuring unit 2 measures vibration of the cold rolling mill and outputs an electrical signal indicating the measured vibration to the sign vibration determining unit 3.

The sign vibration determining unit 3 includes an information processor such as a personal computer. The sign vibration determining unit 3 functions with an arithmetic processing unit, such as a central processing unit (CPU), in the information processor executing a computer program. The functions of the sign vibration determining unit 3 will be described later.

The chattering detection device 1 of the cold rolling mill configured as above executes chattering sign detecting processing, which will be described later, and detects a chattering sign vibration to avoid troubles derived from chattering. Operation of the chattering detection device 1 of the cold rolling mill in executing the chattering sign detecting processing will now be described with reference to FIG. 6.

Figure 6:
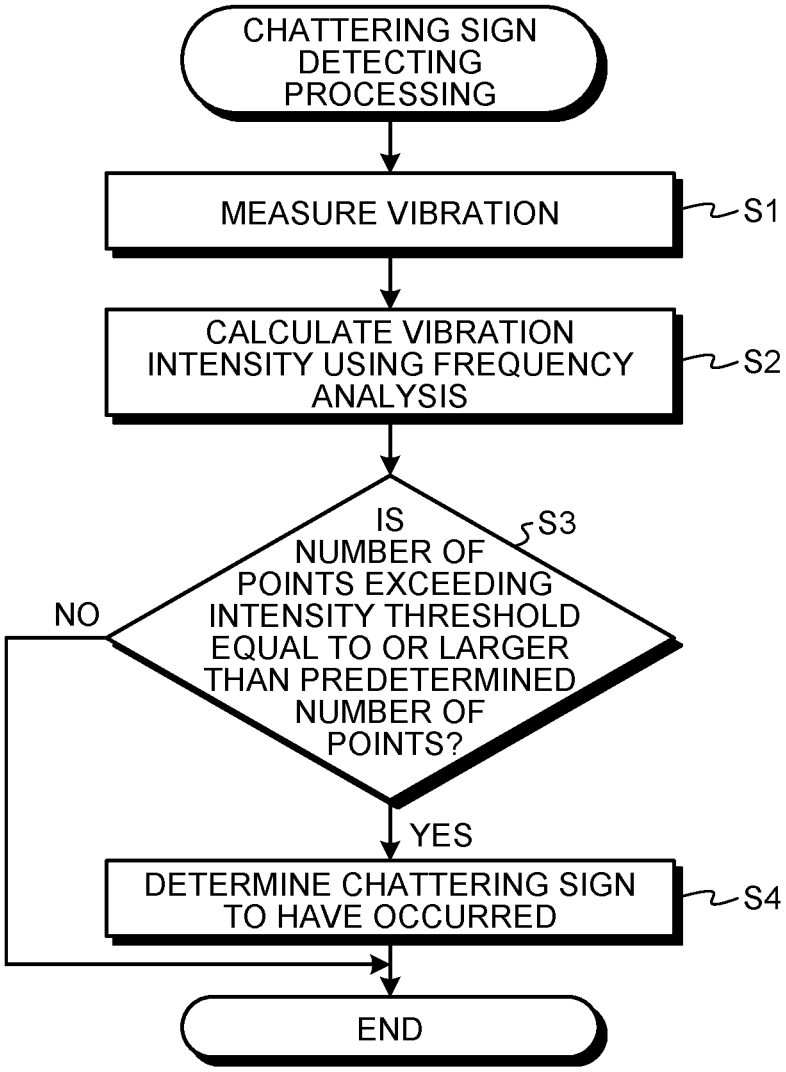
FIG. 6 is a flowchart that illustrates a flow of chattering sign detecting processing of an embodiment of the present invention.

FIG. 6 is a flowchart that illustrates a flow of the chattering sign detecting processing of an embodiment of the present invention. The flowchart of FIG. 6 starts when a material to be rolled is threaded into the cold rolling mill, and the chattering sign detecting processing proceeds to the processing of Step S1. The chattering sign detecting processing is repeatedly performed on every predetermined control period.

At the processing of Step S1, the vibration measuring unit 2 measures vibrations of the cold rolling mill in a predetermined range of measurement time, and outputs an electrical signal indicative of the measured vibrations to the sign vibration determining unit 3. The processing of Step S1 is completed, and the chattering sign detecting processing proceeds to the processing of Step S2.

At the processing of Step S2, using the electrical signal output from the vibration measuring unit 2, the sign vibration determining unit 3 conducts frequency analysis on a time waveform of vibration of the cold rolling mill for a predetermined period equal to or shorter than a time in which a periodic vibration continues without converging. The sign vibration determining unit 3 then calculates a time waveform of vibration intensity. The processing of Step S2 is completed, and the chattering sign detecting processing proceeds to the processing of Step S3.

At the processing of Step S3, using the time waveform of vibration intensity calculated at the processing of Step S2, the sign vibration determining unit 3 determines whether the number of points having vibration intensity values that exceed a predetermined threshold is larger than a predetermined number of points. If the determination result indicates that the number of points each having a vibration intensity that exceeds the predetermined threshold is equal to or larger than the predetermined number of values (Yes at Step S3), the sign vibration determining unit 3 forwards the chattering sign detecting processing to the processing of Step S4. If the number of points having vibration intensity values that exceed the predetermined threshold is smaller than the predetermined number of values (No at Step S3), the sign vibration determining unit 3 ends the series of chattering sign detecting processing.

At the processing of Step S4, the sign vibration determining unit 3 determines a chattering sign vibration to have occurred, and outputs a control signal that instructs a reduction in the speed of rolling to the PLC controlling the cold rolling mill. The processing of Step S4 is completed, and the series of chattering sign detecting processing ends.

Example

In this example, a five-stand four-high tandem rolling mill was used to cold roll a steel sheet (a sheet width of 1200 mm, a final thickness of 0.3 mm) to be cold rolled at 700 mpm, and analysis of chattering vibration was conducted. Specifically, out of the above-described methods to measure vibrations, an accelerometer installed on a mill housing post was used to measure vertical vibration. The measured vibration data was input to an analyzer in an analogue fashion. After analog-to-digital conversion, frequency analysis was conducted on the data. The sampling pitch for measurement was set at 3000 Hz, and the frequency analysis was conducted on every 0.17 second. As a criterion to determine abnormality, if two or more points out of the past five values exceed a set threshold, a chattering sign vibration is determined to be present.

Figure 7:
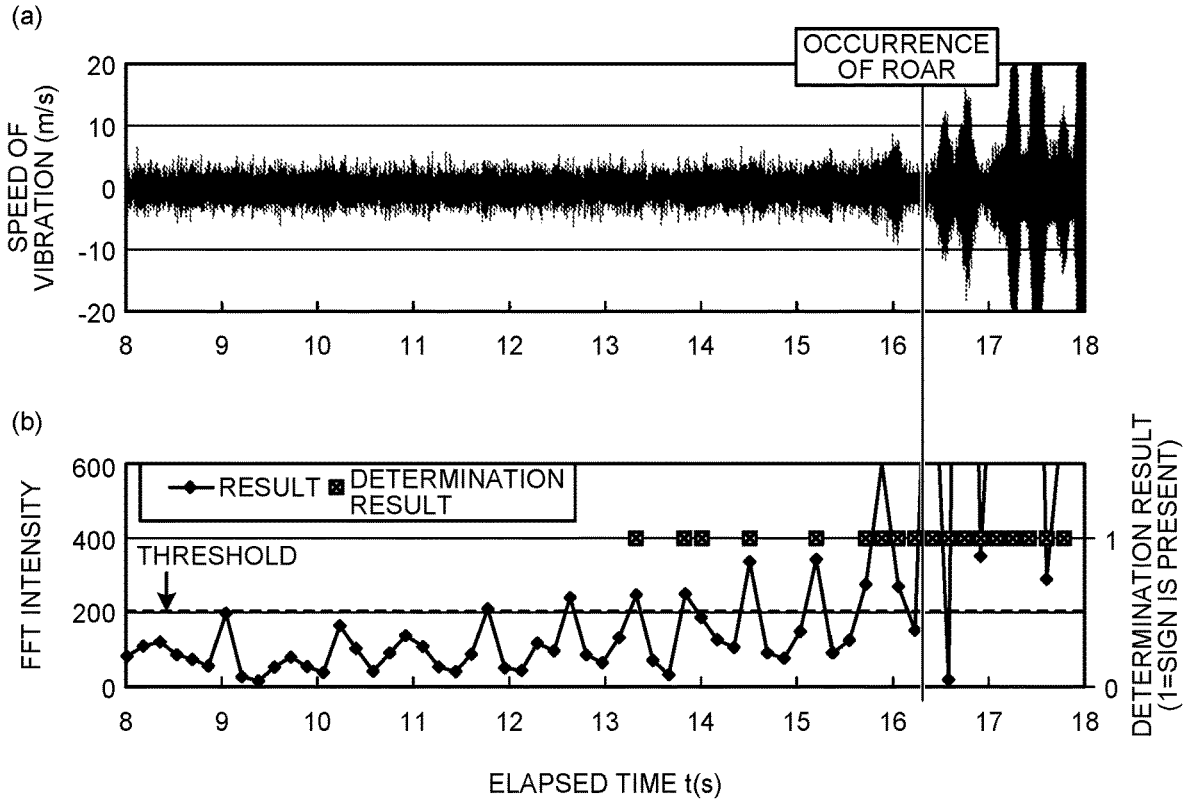
FIG. 7 is a graph that indicates a time waveform of the speed of vibration measured by an accelerometer and a graph in which largest values of FFT intensity are plotted with the horizontal axis as a time axis.

FIG. 7(*a*) illustrates a time waveform of the speed of vibration measured by the accelerometer. In this example, during rolling at a rolling speed of 700 mpm, chattering occurs at a frequency of around 110 Hz. As the next step, FFT analysis was conducted on a time waveform of the measured speed of vibration. FIG. 7(*b*) is a graph in which the largest values of FFT intensity in the range of 100 to 120 Hz are plotted with the horizontal axis as a time axis. FIG. 7(*b*) additionally indicates timings when a chattering sign vibration is determined to be present. In this example, for experiment, even when a chattering sign vibration was determined to be present, no measurement such as a speed reduction was taken, and the operation was continued. After about 3.5 seconds from first determination of a chattering sign, chattering having large intensity has occurred with a huge roar, and the sheet broke. This case reveals that if measurement of a speed reduction was taken at the time of detection of a sign vibration, breakage would have been avoided.

Figure 8:
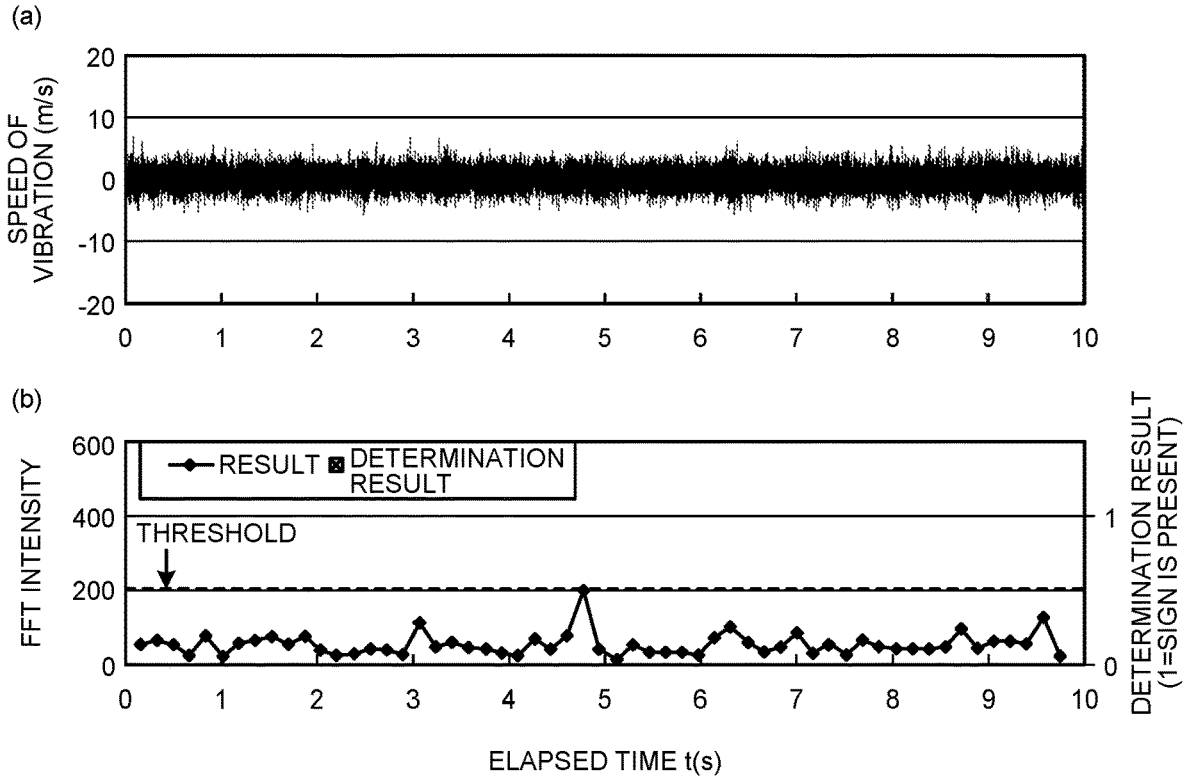
FIG. 8 is a graph that indicates a time waveform of the speed of vibration measured by an accelerometer and a graph in which largest values of FFT intensity are plotted with the horizontal axis as a time axis.

FIGS. 8(*a*) and 8(*b*) indicate results of another opportunity in which a material to be rolled, made of the same kind of steel and having the same size as the above-described material, was rolled at the speed of rolling of 700 mpm. As illustrated in FIGS. 8(*a*) and 8(*b*), in this opportunity, the rolling operation was completed without undergoing chattering. Although some noises are detected, no timings are determined to be abnormal by reason of the presence of a chattering sign. This opportunity is therefore considered to be successful in accurately capturing a sign vibration without causing overdetection.

An embodiment of an invention of the present inventors has been described above. It should be noted that the present invention is not limited by the description and drawings in the embodiment, which constitute a part of disclosure of the present invention. For example, other embodiments, examples, and operational techniques performed by the skilled person and others based on the embodiment are all included in the scope of the present invention.

INDUSTRIAL APPLICABILITY

According to the present invention, it is possible to provide a chattering detection method for a cold rolling mill, a chattering detection device for a cold rolling mill, a cold rolling method, and a cold rolling mill that are able to detect a chattering sign vibration and prevent troubles derived from chattering.

REFERENCE SIGNS LIST

1 CHATTERING DETECTION DEVICE OF COLD ROLLING MILL
2 VIBRATION MEASURING UNIT
3 SIGN VIBRATION DETERMINING UNIT

The invention claimed is:

1. A chattering detection method for a cold rolling mill, the method comprising:
measuring a vibration of a cold rolling mill;
calculating a time waveform of vibration intensity by performing frequency analysis on a time waveform of the measured vibration of the cold rolling mill for a predetermined period equal to or shorter than a time in which a periodic vibration continues without converging; and
detecting a chattering sign vibration of the cold rolling mill based on a number of points having vibration intensity values that exceed a predetermined threshold, the points being included in the calculated time waveform of the vibration intensity.

2. The chattering detection method for the cold rolling mill according to claim 1, wherein a predetermined period for which the frequency analysis is performed is equal to or shorter than 0.5 second.

3. The chattering detection method for the cold rolling mill according to claim 1, further comprising
reducing a speed of rolling of the cold rolling mill when the chattering sign vibration of the cold rolling mill is detected.

4. The chattering detection method for the cold rolling mill according to claim 2, further comprising
reducing a speed of rolling of the cold rolling mill when the chattering sign vibration of the cold rolling mill is detected.

5. A chattering detection device for a cold rolling mill, comprising:
a vibration measuring unit configured to measure a vibration of a cold rolling mill; and
a processor comprising hardware, the processor being configured to:
calculate a time waveform of vibration intensity by performing frequency analysis on a time waveform of vibration measured by the vibration measuring unit for a predetermined period equal to or shorter than a time in which a periodic vibration continues without converging; and detect a chattering sign vibration of the cold rolling mill based on the number of points having vibration intensity values that exceed a predetermined threshold, the points being included in the time waveform of the calculated vibration intensity.

6. The chattering detection device for the cold rolling mill according to claim 5, wherein the processor is configured to conduct frequency analysis for a predetermined period of equal to or shorter than 0.5 second.

7. The chattering detection device for the cold rolling mill according to claim 5, wherein the processor is configured to reduce a speed of rolling of the cold rolling mill when the chattering sign vibration of the cold rolling mill is detected.

8. The chattering detection device for the cold rolling mill according to claim 6, wherein the processor is configured to reduce a speed of rolling of the cold rolling mill when the chattering sign vibration of the cold rolling mill is detected.

9. A cold rolling method comprising cold rolling using a chattering detection method including:

measuring a vibration of a cold rolling mill;

calculating a time waveform of vibration intensity by performing frequency analysis on a time waveform of the measured vibration of the cold rolling mill for a predetermined period equal to or shorter than a time in which a periodic vibration continues without converging; and detecting a chattering sign vibration of the cold rolling mill based on a number of points having vibration intensity values that exceed a predetermined threshold, the points being included in the calculated time waveform of the vibration intensity.

10. The cold rolling method according to claim 9, wherein a predetermined period for which the frequency analysis is performed is equal to or shorter than 0.5 second.

11. The cold rolling method according to claim 9, further comprising reducing a speed of rolling of the cold rolling mill when the chattering sign vibration of the cold rolling mill is detected.

12. The cold rolling method according to claim 10, further comprising reducing a speed of rolling of the cold rolling mill when the chattering sign vibration of the cold rolling mill is detected.

13. A cold rolling mill comprising a chattering detection device including:

a vibration measuring unit configured to measure a vibration of a cold rolling mill; and a processor comprising hardware, the processor being configured to:

calculate a time waveform of vibration intensity by performing frequency analysis on a time waveform of vibration measured by the vibration measuring unit for a predetermined period equal to or shorter than a time in which a periodic vibration continues without converging; and detect a chattering sign vibration of the cold rolling mill based on the number of points having vibration intensity values that exceed a predetermined threshold, the points being included in the time waveform of the calculated vibration intensity.

14. The cold rolling mill according to claim 13, wherein the processor is configured to conduct frequency analysis for a predetermined period of equal to or shorter than 0.5 second.

15. The cold rolling mill according to claim 13, wherein the processor is configured to reduce a speed of rolling of the cold rolling mill when the chattering sign vibration of the cold rolling mill is detected.

16. The cold rolling mill according to claim 14, wherein the processor is configured to reduce a speed of rolling of the cold rolling mill when the chattering sign vibration of the cold rolling mill is detected.

* * * * *